US007716772B2

(12) United States Patent
Shih et al.

(10) Patent No.: US 7,716,772 B2
(45) Date of Patent: May 18, 2010

(54) CLEANING APPARATUS

(75) Inventors: Jui-Pin Shih, Gueishan Township, Taoyuan County (TW); Yi-Ming Lin, Gueishan Township, Taoyuan County (TW); Chih-Chiang Chen, Gueishan Township, Taoyuan County (TW)

(73) Assignee: AU Optronics Corp., Hsinchu (TW)

( * ) Notice: Subject to any disclaimer, the term of this patent is extended or adjusted under 35 U.S.C. 154(b) by 1108 days.

(21) Appl. No.: 11/368,718

(22) Filed: Mar. 6, 2006

(65) Prior Publication Data

US 2006/0200921 A1 Sep. 14, 2006

(30) Foreign Application Priority Data

Mar. 8, 2005 (TW) ..... 94106952 A

(51) Int. Cl.
*B08B 1/04* (2006.01)
*H01T 19/00* (2006.01)

(52) U.S. Cl. ..... 15/21.1; 15/3; 15/97.1; 15/246; 250/324; 361/213; 361/230

(58) Field of Classification Search ..... 15/3, 15/21.1, 88, 88.2–88.4, 97.1, 246, 256.5, 15/28

See application file for complete search history.

(56) References Cited

U.S. PATENT DOCUMENTS

| | | | | | |
|---|---|---|---|---|---|
| 1,853,996 | A | * | 4/1932 | Putzel | 15/3.16 |
| 2,080,197 | A | * | 5/1937 | Brandenburg | 15/3.16 |
| 2,080,198 | A | * | 5/1937 | Brandenburg | 15/3.16 |
| 3,324,493 | A | * | 6/1967 | Kraft | 15/88.3 |
| 4,734,580 | A | * | 3/1988 | Rodrigo et al. | 250/324 |
| 4,885,815 | A | * | 12/1989 | Smith | 15/28 |
| 5,099,536 | A | * | 3/1992 | Hirabayashi | 15/28 |

FOREIGN PATENT DOCUMENTS

| | | |
|---|---|---|
| JP | 0239256 | 3/1990 |
| JP | 08008039 | 12/1996 |
| JP | 2001267038 | 9/2001 |

* cited by examiner

*Primary Examiner*—Mark Spisich
(74) *Attorney, Agent, or Firm*—Thomas, Kayden, Horstemeyer & Risley

(57) ABSTRACT

A cleaning apparatus comprises a housing, a driving mechanism and a plurality of cleaning elements. The driving mechanism is disposed in the housing. The cleaning elements are connected to the driving mechanism. The driving mechanism rotates the cleaning elements to clean the emitters.

14 Claims, 7 Drawing Sheets

CLEANING APPARATUS

BACKGROUND

The invention relates to a cleaning apparatus, and more particularly to a cleaning apparatus for cleaning emitters of an ionizer.

A glass substrate of a flat panel display is electrically isolated, and gathers static electricity during the manufacturing process of a flat panel display. The static electricity deteriorates characteristics of electric elements disposed on the glass substrate, and decreases reliability of the flat panel display. Thus, in the manufacturing process of flat panel display, an ionizer is provided to increase the amount of charged ions in the air for neutralizing static electricity on the glass substrate.

As shown in FIG. 1, ionizer 1 comprises a plurality of emitters 2 disposed on a side thereof. Emitters are made of silicon, titanium or other materials and tips thereof are cone-shaped. Charged ions are produced around the tips of emitters 2. Ionizer 1 is vertically or horizontally disposed in process equipment, particularly in a passage for transporting glass substrates or a process chamber.

Tips of emitters 2 attract particles in the air and react with chemical gas in the process; thus, ion production efficiency thereof decreases over time. Conventionally, each emitter 2 is cleaned manually with a foam plastic and isopropyl alcohol (IPA) to recover ion production efficiency, which costs additional time and effort, and delays the manufacturing process.

SUMMARY

According to the present invention, a cleaning apparatus is provided. The cleaning apparatus comprises a housing, a driving mechanism and a plurality of cleaning elements. The driving mechanism is disposed in the housing. The cleaning elements are connected to the driving mechanism. The driving mechanism rotates the cleaning elements to clean the emitters.

The cleaning apparatus of the present invention cleans the emitters of the ionizer simultaneously and quickly, avoiding delay of the manufacturing process and reducing effort.

BRIEF DESCRIPTION OF THE DRAWINGS

The invention will be more fully understood from the following detailed description and the accompanying drawings, given by the way of illustration only and thus not intended to limit the disclosure.

DETAILED DESCRIPTION

Figure 1:
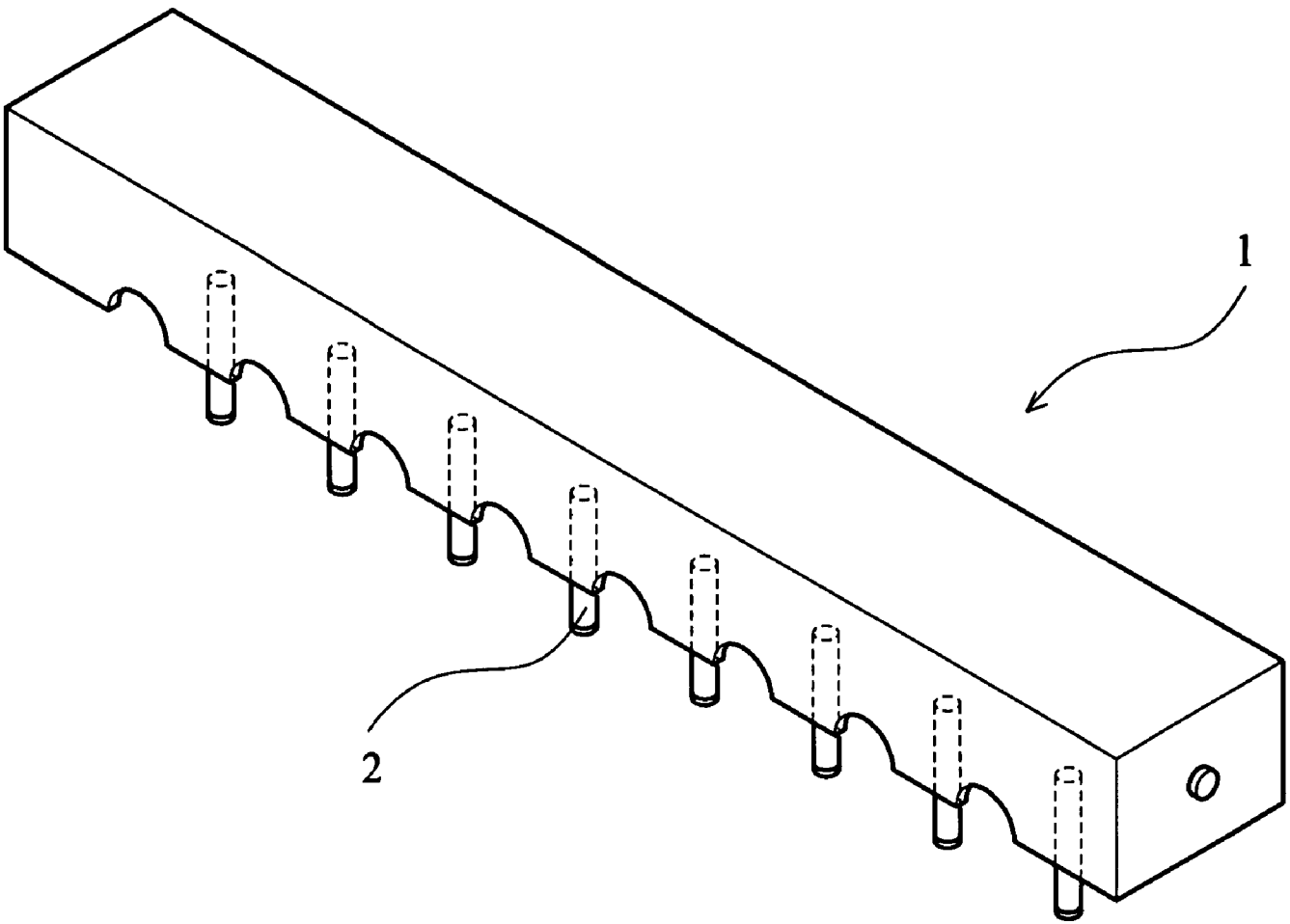
FIG. 1 ( RELATED ART )
FIG. 1 is a perspective view of an ionizer.
Figure 2A:
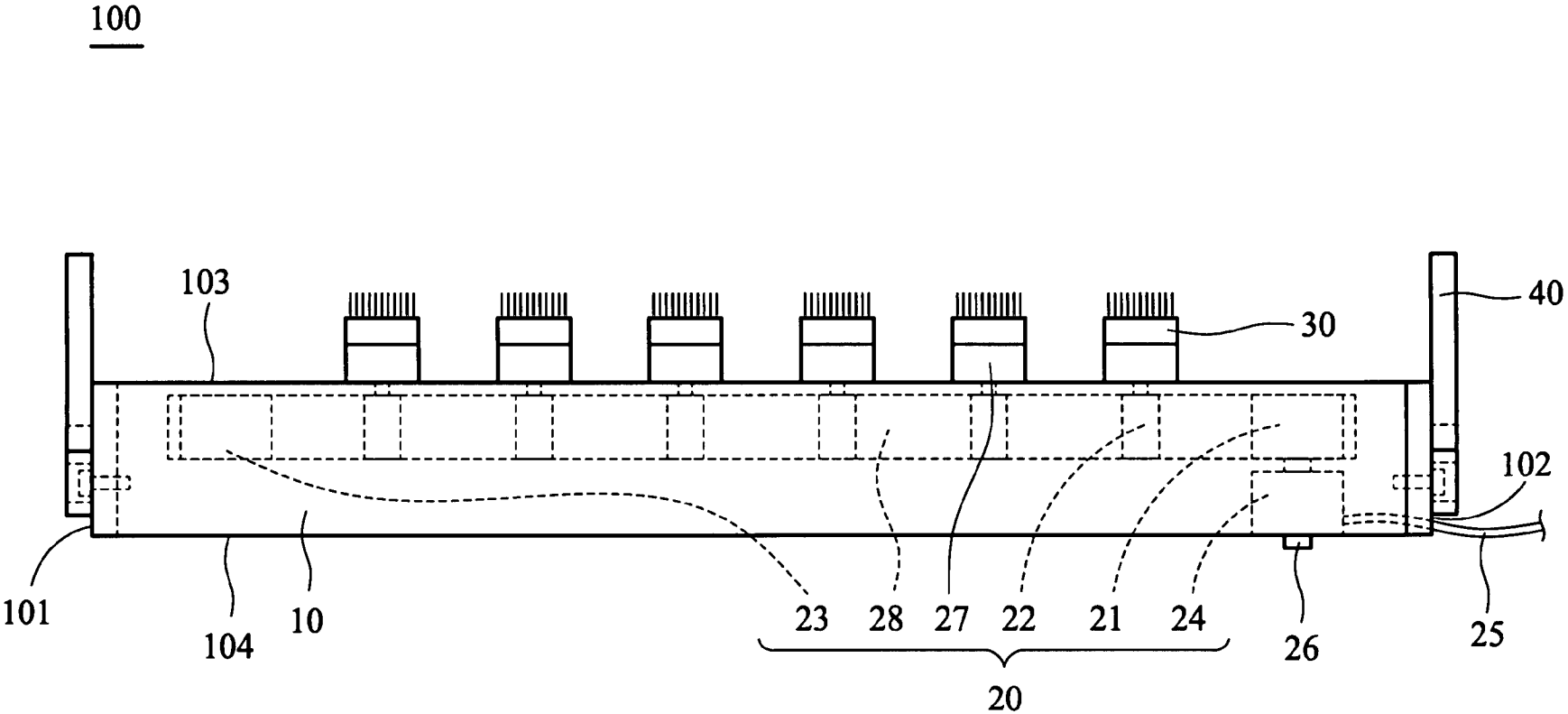
FIG. 2*a* is a side view of a cleaning apparatus of the invention.

As shown in FIG. 2*a*, the invention provides a cleaning apparatus 100 to clean the emitters mentioned above. The cleaning apparatus 100 comprises a housing 10, a driving mechanism 20, a switch 26, a plurality of cleaning elements 30 and two positioners 40. The housing 10 is cuboid and comprises a first end surface 101, a second end surface 102, a first planar surface 103 and a second planar surface 104. The driving mechanism 20 is disposed in the housing 10. The cleaning elements 30 arranged on the first planar surface 103 are connected to the driving mechanism 20 and rotated thereby. The switch 26 is disposed on the second planar surface 104 and activates the driving mechanism 20. The positioners 40 are separately disposed on the first end surface 101 and the second end surface 102. A power line 25 is coupled to the driving mechanism 20 to supply power.

Figure 2B:
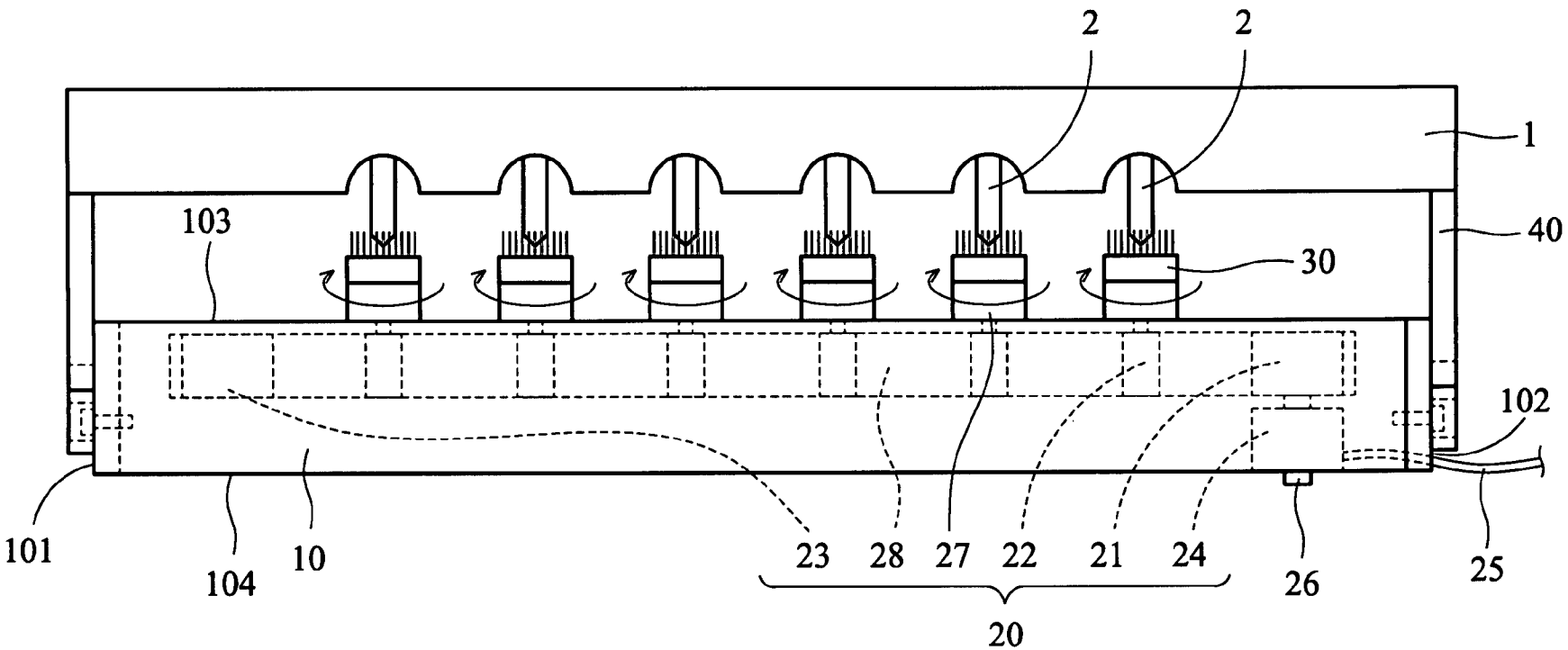
FIG. 2*b* shows the cleaning apparatus of the invention cleaning the ionizer.

As shown in FIG. 2*b*, the driving mechanism 20 rotates the cleaning elements 30 to clean the tips of the emitters 2, and the positioners 40 abut a surface of the ionizer 1 to control a distance between the cleaning elements 30 and the emitters 2.

Figure 3:
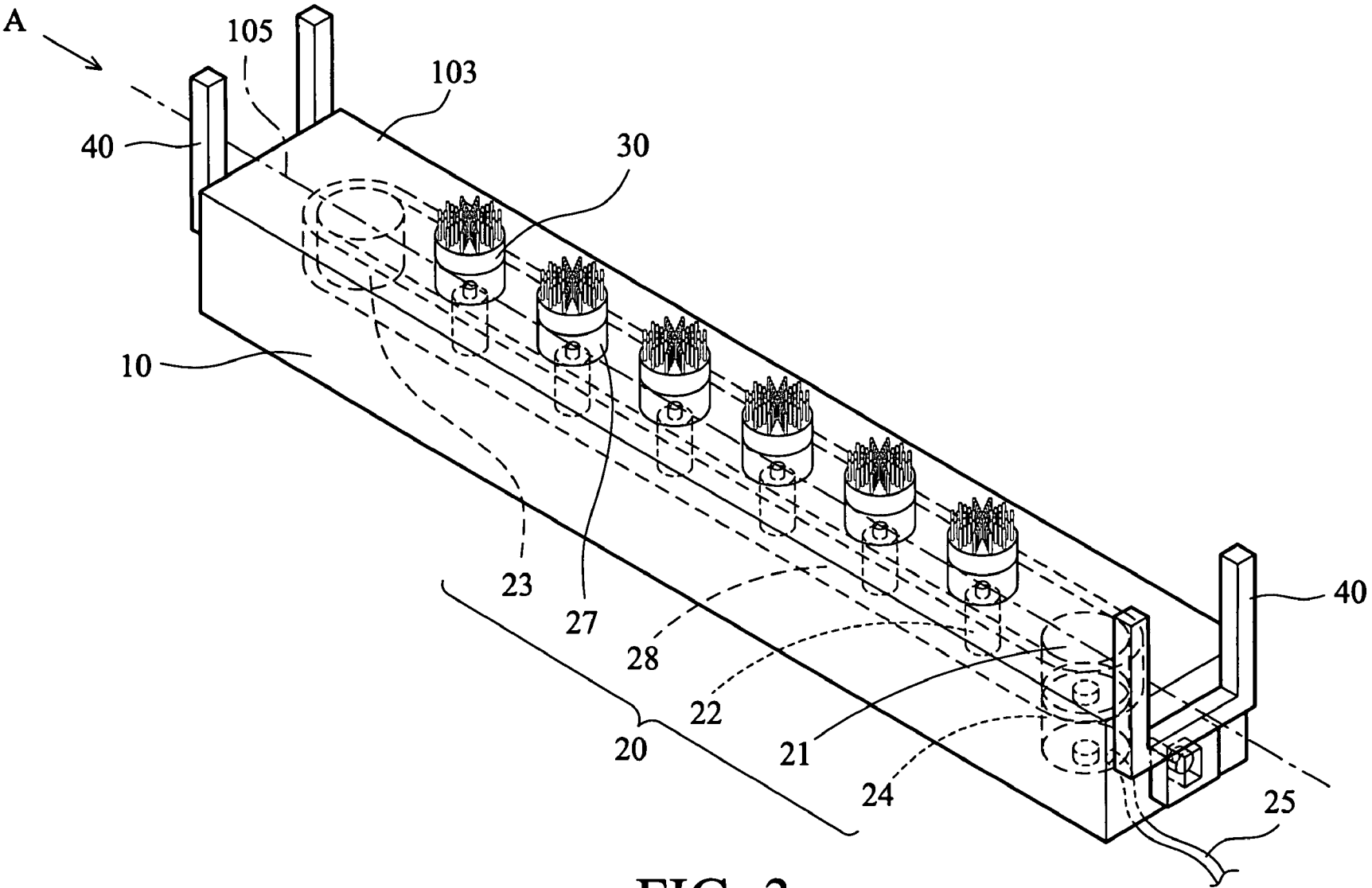
FIG. 3 is a perspective view of the cleaning apparatus of the invention.

With reference to FIG. 3, the driving mechanism 20 comprises a driver 24, a first roller 21, a plurality of second rollers 22, a third roller 23, a plurality of fastening structures 27 and a belt 28. Driver 24 is an electric motor, which coaxially rotates the first roller 21. The first roller 21 activates the belt 28 and the third roller 23. The belt 28 contacts and rotates the second rollers 22. The second rollers 22 are connected to the cleaning elements 30 via the fastening structures 27, and rotate the cleaning elements coaxially. The diameter of the first roller 21 is greater than the diameter of the second rollers 22. Thus, a rotation speed of the second roller 22 is faster than that of the first roller 21. The cleaning elements 30 are disposed equidistantly along a straight line 105, and rotation axes thereof are perpendicular to the straight line 105.

The cleaning elements 30 are not limited to being disposed equidistantly, the arrangement can also correspond to the arrangement of the emitters.

The belt 28 is a flat belt. The invention is not limited to rotating the cleaning elements 30 via the belt. The cleaning elements 30 can also be rotated via other means (for example, gears).

Figure 4A:
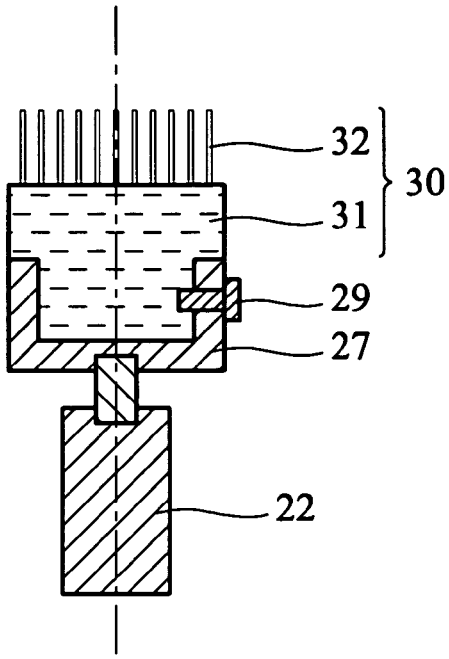
FIG. 4*a* shows a cleaning element connected to a second roller.

As shown in FIG. 4*a*, the fastening structure 27 is disposed on the second roller 22. The cleaning element 30 comprises a body 31 and brush hairs 32 to brush the emitters. The cleaning element 30 is detachably connected to the fastening structure 27 via fastener 29. The fastener 29 is a bolt. Thus, the cleaning element 30 is connected to the second roller 22.

Figure 4B:
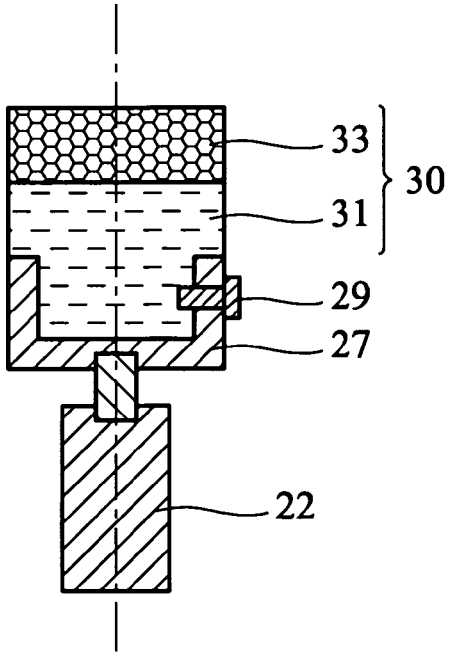
FIG. 4*b* shows a modified example of the cleaning element.
Figure 4C:
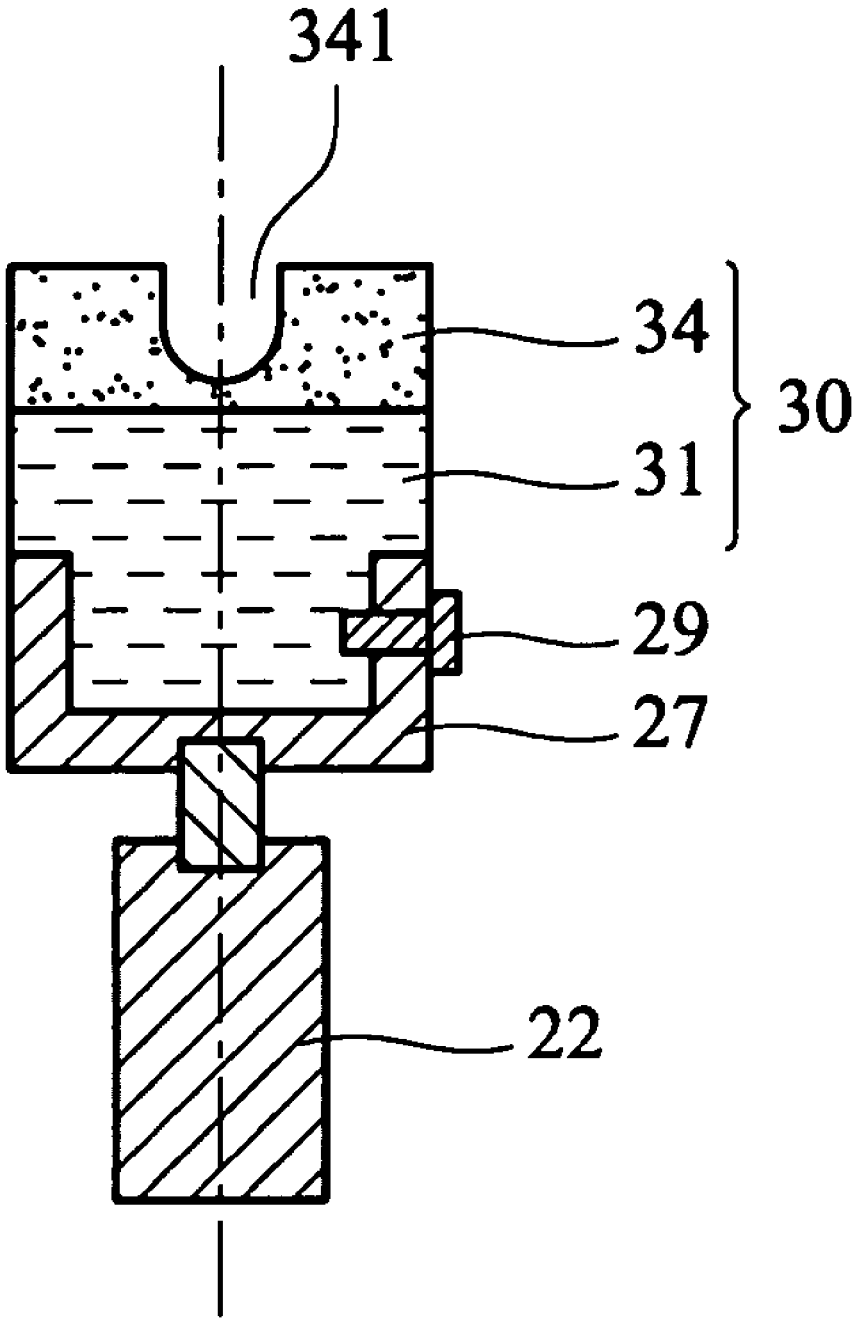
FIG. 4*c* shows another modified example of the cleaning element.

FIG. 4*b* shows a modified example of the invention, wherein the brush hairs 32 are replaced with foam plastic 33 or other soft elastic materials to clean the emitters with isopropyl alcohol (IPA). FIG. 4*c* shows another modified example of the invention, wherein the foam plastic 33 is replaced with a ceramic portion 34. A recess 341 is formed on the ceramic portion 34 corresponding to the shape of the tip of the emitter. The ceramic portion 34 rubs away metal oxide or other obstinate products on the surface of the emitter. The invention can be modified in the material, shape or design of the cleaning elements according to the product to be removed from the emitters.

Figure 5A:
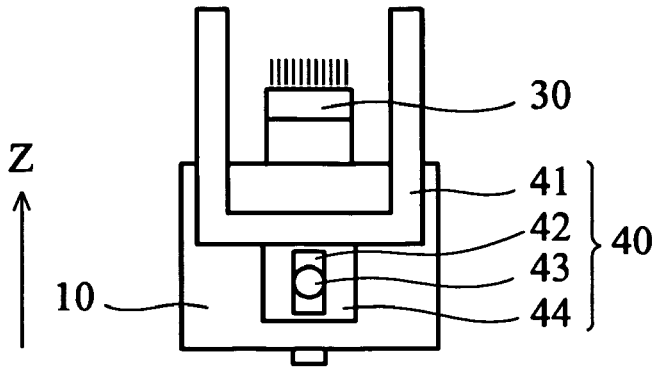
FIG. 5*a* is a side view in direction A of FIG. 3.

FIG. 5*a* is a side view in direction A of FIG. 3, in which the positioner 40 comprises a body 44, a groove 42, a second fastener 43 and a positioning portion 41. The groove 42 is formed on the body 44. The second fastener 43 fixes the body 44 on the housing 10 through the groove 42. The positioning portion 41 is U-shaped and connected to the body 44 to abut the ionizer. The positioner 40 slides along a first axis Z via the groove 42 with respect to the second fastener 43 to control a distance between the cleaning elements 30 and the emitters to prevent the cleaning elements 30 from striking or damaging the emitters.

Figure 5B:
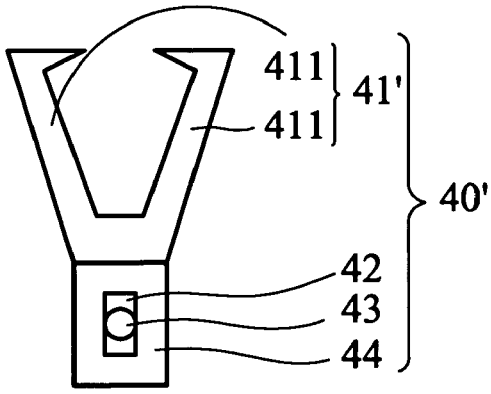
FIG. 5*b* shows a modified example of the positioner.
Figure 5C:
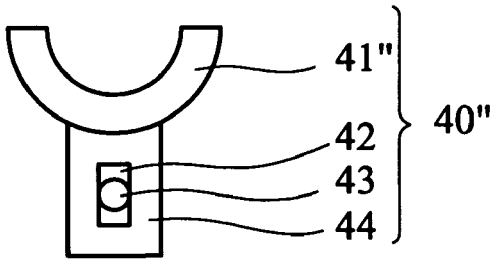
FIG. 5*c* shows another modified example of the positioner.

FIG. 5*b* shows a modified positioner 40' of the invention, in which the positioning portion 41' comprises two supporting arms 411 extending separately along the first axis. FIG. 5*c* shows another modified positioner 40" of the invention, wherein the positioning portion 41" is arc-shaped.

The cleaning apparatus of the invention cleans the emitters of the ionizer simultaneously and quickly. Thus, delays in the manufacturing process are avoided and effort is reduced.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A cleaning apparatus for cleaning a plurality of emitters of an ionizer, comprising:

a housing;

a driving mechanism, disposed in the housing;

a plurality of cleaning elements, connected to the driving mechanism, wherein the driving mechanism rotates the cleaning elements to clean the emitters; and a positioner disposed on the housing for abutting the ionizer to control a distance between the cleaning elements and the emitters, wherein the positioner comprises a body, a groove disposed on the body, a fastener fixing the body on the housing through the groove, and a positioning portion connected to the body to abut the ionizer, wherein the positioner slides along a first axis via the groove with respect to the fastener to control the distance.

2. The cleaning apparatus as claimed in claim 1, wherein each cleaning element comprises a soft elastic material to clean the emitters.

3. The cleaning apparatus as claimed in claim 2, wherein the soft elastic material is foam plastic.

4. The cleaning apparatus as claimed in claim 1, wherein each cleaning element comprises a plurality of brush hairs to clean the emitters.

5. The cleaning apparatus as claimed in claim 1, wherein each cleaning element comprises a ceramic portion, and the ceramic portion rubs off a product on the emitter.

6. The cleaning apparatus as claimed in claim 1, wherein the cleaning elements are detachably connected to the driving mechanism.

7. The cleaning apparatus as claimed in claim 1, wherein the cleaning elements are disposed corresponding to the emitters.

8. The cleaning apparatus as claimed in claim 1, wherein the cleaning elements are disposed equidistantly along a straight line.

9. The cleaning apparatus as claimed in claim 8, wherein a plurality of rotation axes of the cleaning elements are perpendicular to the straight line.

10. The cleaning apparatus as claimed in claim 1, wherein the driving mechanism comprises:

a driver;

a first roller, connected to the driver and rotated thereby;

a belt, contacting the first roller and activated thereby; and a plurality of second rollers, contacting the belt and rotated thereby, wherein the cleaning elements are disposed on the second rollers, and rotated thereby.

11. The cleaning apparatus as claimed in claim 10, wherein the cleaning elements are detachably disposed on the second rollers.

12. The cleaning apparatus as claimed in claim 1, wherein the positioning portion is U-shaped.

13. The cleaning apparatus as claimed in claim 1, wherein the positioning portion comprises two supporting arms extending separately along the first axis.

14. The cleaning apparatus as claimed in claim 1, wherein the positioning portion is arc-shaped.

* * * * *